US008939049B2

(12) United States Patent
Li

(10) Patent No.: US 8,939,049 B2
(45) Date of Patent: Jan. 27, 2015

(54) SOCKET SET

(76) Inventor: An-Li Li, Taichung (TW)

( * ) Notice: Subject to any disclaimer, the term of this patent is extended or adjusted under 35 U.S.C. 154(b) by 268 days.

(21) Appl. No.: 13/545,600

(22) Filed: Jul. 10, 2012

(65) Prior Publication Data

US 2014/0013905 A1 Jan. 16, 2014

(51) Int. Cl.
*B25B 13/06* (2006.01)

(52) U.S. Cl.
USPC ..... 81/124.4; 81/124.6

(58) Field of Classification Search
USPC ..... 81/121.1, 124.4, 124.5, 124.6, 185, 81/DIG. 11; 24/673, 675, 676, 668
See application file for complete search history.

(56) References Cited

U.S. PATENT DOCUMENTS

| | | | | | |
|---|---|---|---|---|---|
| 437,103 | A * | 9/1890 | Drake | 24/673 |
| 1,281,438 | A * | 10/1918 | Tuttle | 81/124.5 |
| 3,187,610 | A * | 6/1965 | Russman | 81/185 |
| 4,620,460 | A * | 11/1986 | Gonzales, Jr. | 81/124.4 |
| 4,798,111 | A * | 1/1989 | Cheeseman | 81/124.4 |
| 5,048,379 | A * | 9/1991 | Gramera et al. | 81/124.4 |
| 6,269,717 | B1 * | 8/2001 | Bollinger | 81/124.4 |
| 6,332,382 | B1 * | 12/2001 | Anderson et al. | 81/DIG. 11 |
| 2005/0087042 | A1 * | 4/2005 | Huang | 81/124.5 |

* cited by examiner

*Primary Examiner* — Hadi Shakeri
(74) *Attorney, Agent, or Firm* — Muncy, Geissler, Olds & Lowe, P.C.

(57) ABSTRACT

A socket set which includes a first socket, a second socket and a combination mechanism is provided. The first socket and the second socket can be combined together. The combination mechanism can retain the first socket and the second socket in a corresponding position, such that the first socket and the second socket are in a cooperative-motion relationship.

7 Claims, 6 Drawing Sheets

SOCKET SET

BACKGROUND OF THE INVENTION

1. Field of the Invention

The present invention relates to a hand tool, more particularly, to a socket set.

2. Description of the Prior Art

A conventional socket set is usually composed of plural sockets, in which each socket is formed with at least one driving portion and at least one driven portion. The driving portions of the respective sockets are designed in different sizes, while the driven portions tends to be designed in same size to facilitating the use of a driving head of one single driving rod to drive different sockets.

However, since a large-size socket and a small-size socket usually require driven portions with different sizes, an user has to find out not only a socket being correspondingly applied to a screwing member but also a driving rod being correspondingly applied to the socket, so as to complete the driving task. In other words, to screw the screwing member, the user has to prepare plural sockets in advance and has to prepare driving rods being correspondingly applied to various driven portions, thus resulting in inconvenience of use and carrying.

The present invention is, therefore, arisen to obviate or at least mitigate the above mentioned disadvantages.

SUMMARY OF THE INVENTION

The main object of the present invention is to provide a socket set including at least two sockets that can be combined together in a cooperative-motion relationship.

To achieve the above and other objects, a socket set of the present invention includes a first socket, a second socket and a combination mechanism.

The first socket has an inner circumferential surface and an outer circumferential surface, the inner circumferential surface defines a first driving portion and a second driving portion at two sides of the first socket, a first driven portion is formed between the first and second driving portions, the first and second driving portions are adapted for driving a screwing member, the first driven portion is adapted to be driven by a driving rod having a driving head, and the outer circumferential surface is formed with a polygonal engaging surface.

The second socket has an inner circumferential surface and an outer circumferential surface, the inner circumferential surface defines a third driving portion and a fourth driving portion at two sides of the second socket, a second driven portion is formed between the third and fourth driving portions, the third and fourth driving portions are adapted for driving a screwing member, and the second driven portion is adapted to be driven by a driving rod having a driving head.

The polygonal engaging surface is adapted for being fitted in the third driving portion, the first and second sockets are in a cooperative-motion relationship, and the combination mechanism retains the first and second sockets in a corresponding position.

Whereby, one the single driving rod can be used for either of the first socket and the second socket through fitting the first socket into the third driving portion even if the first driven portion and the second driven portion are different in size.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
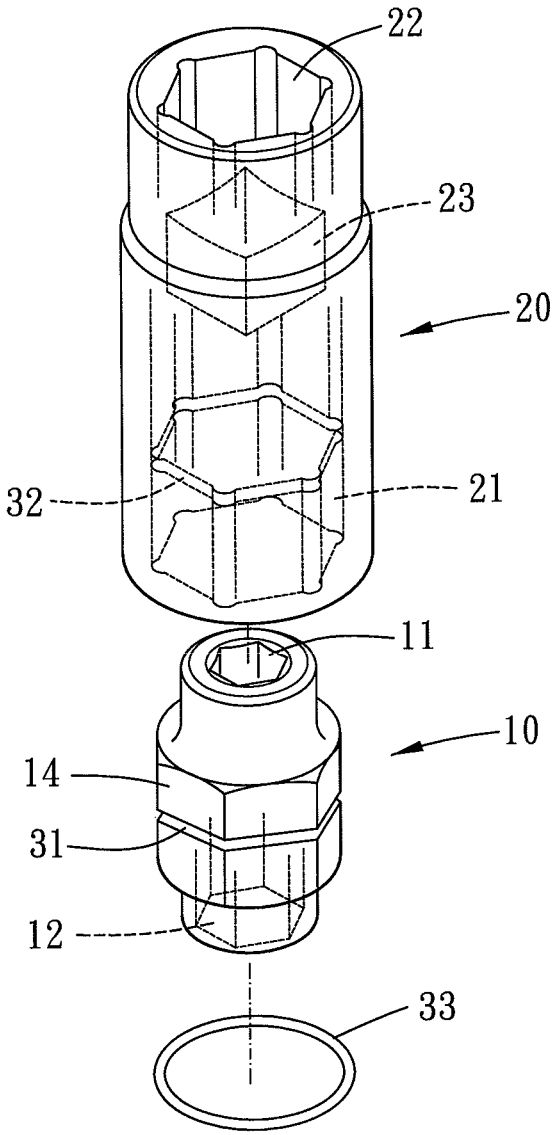
FIG. 1 is an explosion diagram of a socket set of the present invention.
Figure 2:
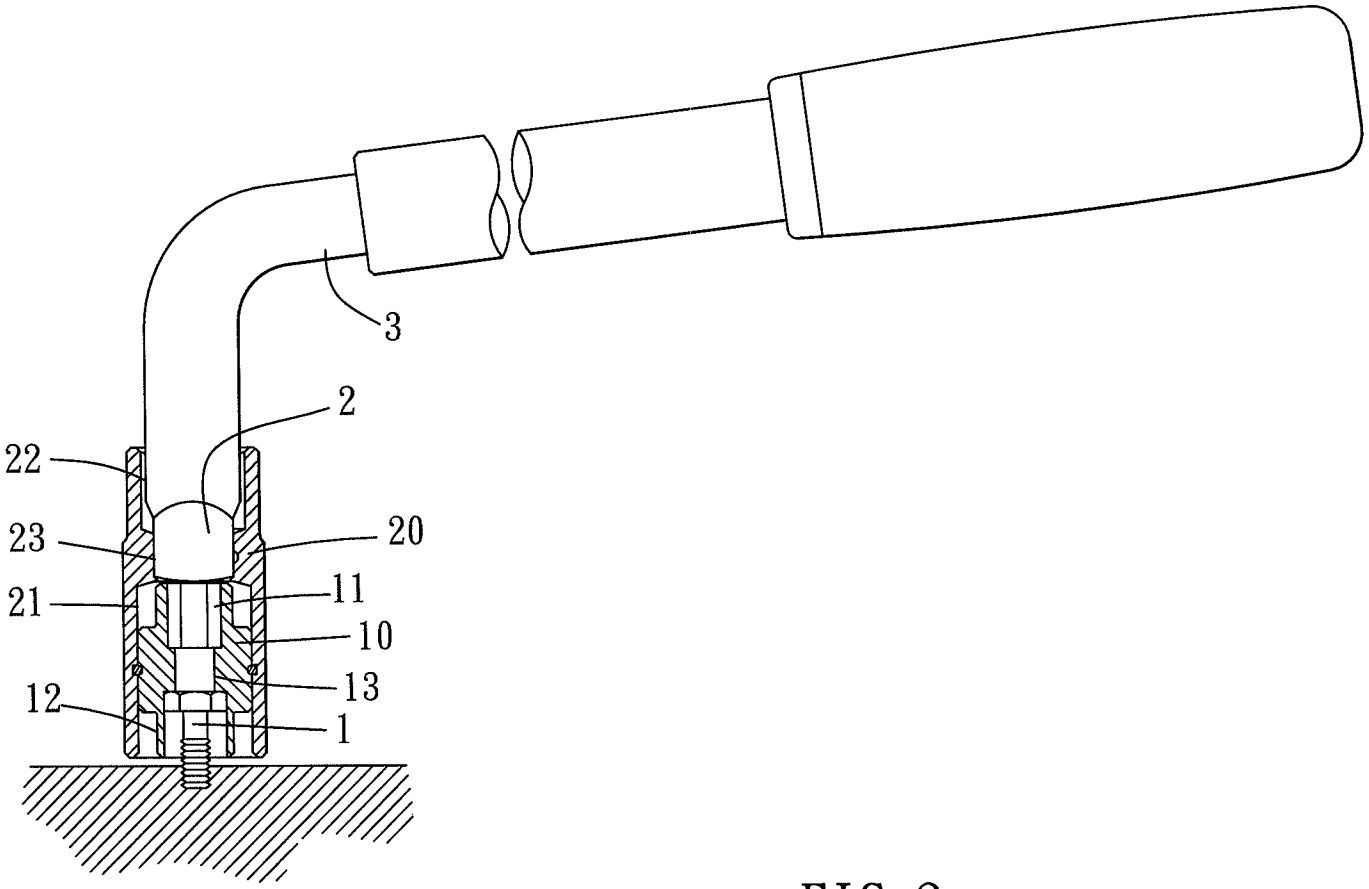
FIG. 2 is a drawing showing the socket set in use according to the present invention.

As shown in FIGS. 1 and 2, a socket set of the present invention includes a first socket 10, a second socket 20 and a combination mechanism. The respective interiors of the first and second sockets 10, 20 are formed with through holes, and the first and second sockets 10, 20 both include an inner circumferential surface and an outer circumferential surface.

Figure 3:
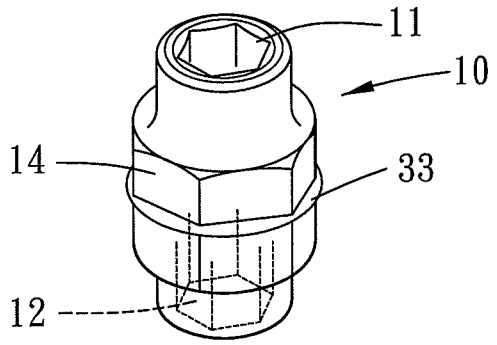
FIG. 3 is a drawing showing a first socket according to a first embodiment of the present invention.
Figure 4:
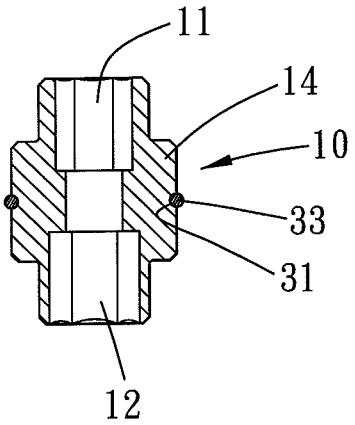
FIG. 4 is a cross-sectional view of the first socket according to the first embodiment of the present invention.
Figure 5:
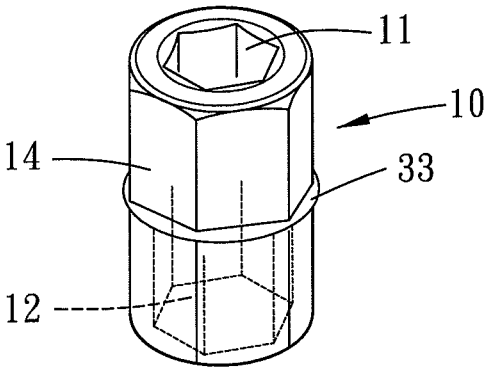
FIG. 5 is a drawing showing a first socket according to a second embodiment of the present invention.
Figure 6:
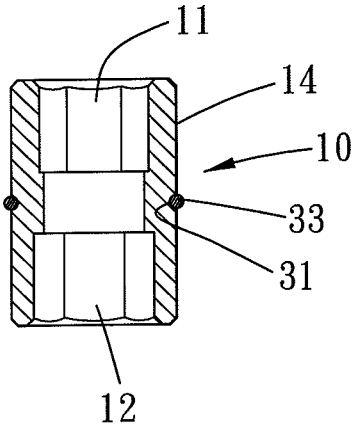
FIG. 6 is a cross-sectional view of the first socket according to the second embodiment of the present invention.

The inner circumferential surface of the first socket 10 defines a first driving portion 11 and a second driving portion 12 at two sides of the first socket, a first driven portion 13 is formed between the first and second driving portions 11, 12, and the outer circumferential surface of the first socket 10 is formed with a polygonal engaging surface 14. The polygonal engaging surface 14 can be arranged on partial outer surface (middle section) of the first socket 10 as shown in FIGS. 3 and 4, or arranged on whole outer surface of the first socket 10 as shown in FIGS. 5 and 6.

Figure 7:
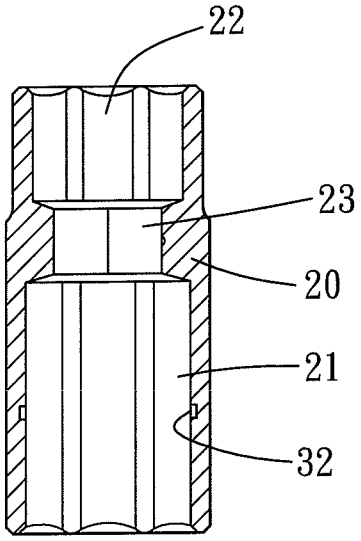
FIG. 7 is a cross-sectional view of a second socket of the present invention.

As shown in FIG. 7, the inner circumferential surface of the second socket 20 defines a third driving portion 21 and a fourth driving portion 22 at two sides of the second socket 20, and a second driven portion 23 is formed between the third and fourth driving portions 21, 22. The polygonal engaging surface 14 is adapted for being fitted in and driven by the third driving portion 21, such that the first and second sockets 10, 20 are in a cooperative-motion relationship.

The first, second, third and fourth driving portions 11, 12, 21, 22 are inner-polygonal (or other suitable arcuate shape) for driving a screwing member 1 and preferably different from each other in size, so as to be adapted for four kinds of screwing members with different size. The first and second driven portions 13, 23 are also inner-polygonal (or other suitable arcuate shape) for being driven respectively by a driving head 2 of a driving rod 3 and different from each other in size, such that no matter that the size of the driving head 2 of the driving rod 3 corresponds to that of the first driven portion 13 or the second driven portion 23, the first and second sockets 10, 20 can be driven simultaneously through the one single driving rod 3 after they are combined together. It is noted that the amount of corners of the polygonal engaging surface 14 is equal to that of the third driving portion 21, such that the first and second sockets 10, 20 are combined together and can be driven simultaneously.

Figure 8:
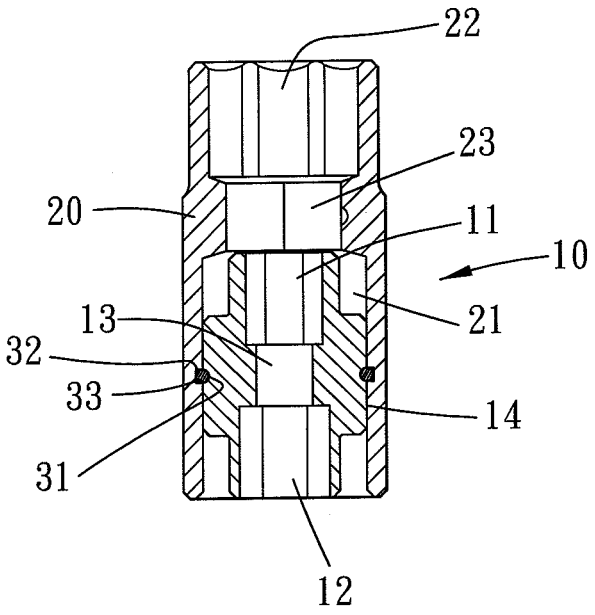
FIG. 8 is a cross-sectional view of the socket set of the present invention.

The combination mechanism is adapted for retaining the first and second sockets 10, 20 in a corresponding position, that is, when the polygonal engaging surface 14 is fitted in the third driving portion 21, the first and second sockets 10, 20 will not be separated from each other due to the effect of gravity. As shown in FIG. 8, in this embodiment, the combination mechanism includes a first recess 31, a second recess 32 and a ring 33. The first recess 31 is disposed around the polygonal engaging surface 14, the second recess 32 is disposed around the third driving portion 21, and the ring 33 is received in the first recess 31 or the second recess 32. When the polygonal engaging surface 14 is received in the third driving portion 21, the first and second recesses 31, 32 correspond to each other and the ring 33 is limited in the first and second recesses 31, 32, thus preventing the first and second sockets 10, 20 from separating from each other due to the effect of gravity.

Figure 9:
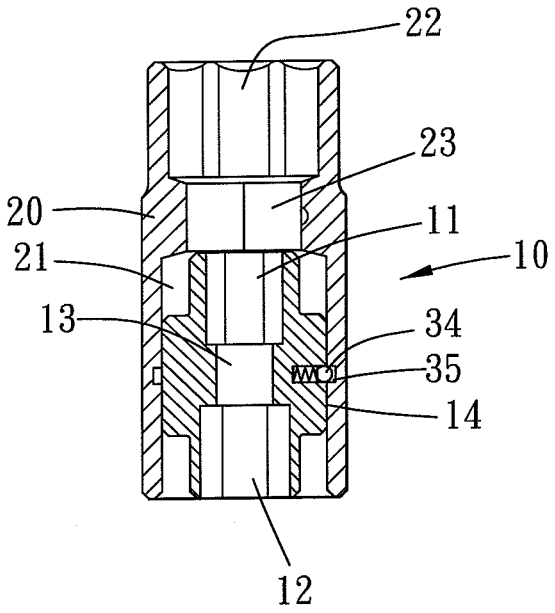
FIG. 9 is a cross-sectional view of another socket set of the present invention.

However, the above-mentioned first and second recesses 31, 32 and the ring 33 might be just an exemplary embodiment of the combination mechanism. In another exemplary embodiment of the combination mechanism as shown in FIG. 9, the combination mechanism is carried out with an engaging member 34 and an receiving slot 35 and the engaging member 34 is engaged in the receiving slot 35, wherein the engaging member 34 is disposed on the polygonal engaging surface 14 (or disposed on the third driving portion 21), and the receiving slot 35 is disposed on the third driving portion 21 (or the polygonal engaging surface 14), such that when the first and second sockets 10, 20 are combined together, the engaging member 34 is received and engaged in the receiving slot 35, and the first and second sockets 10, 20 are retained together.

Figure 10:
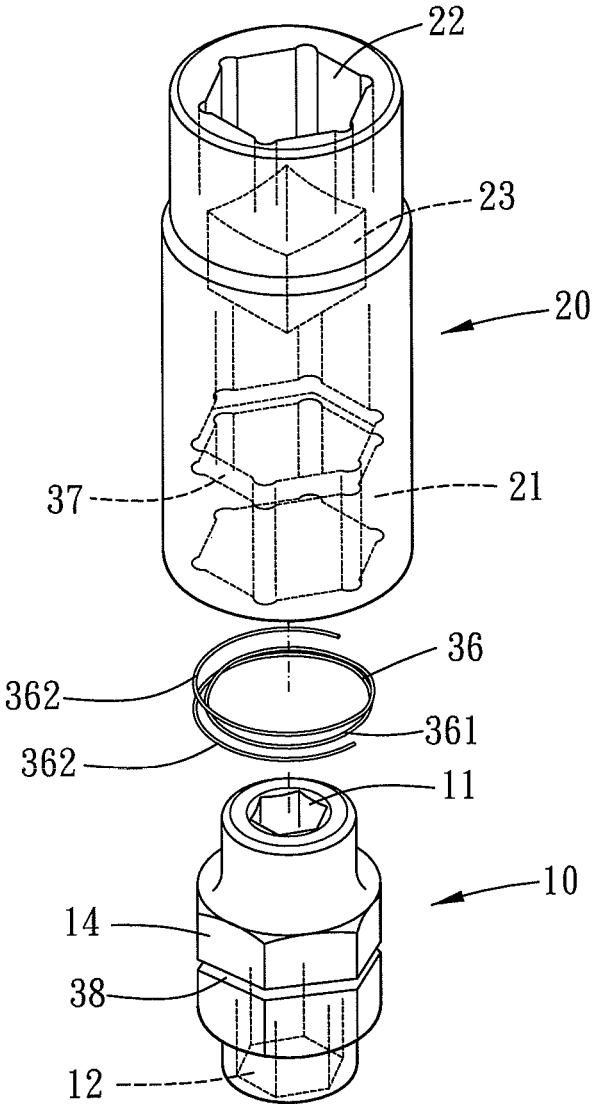
FIG. 10 is an explosion diagram of another socket set of the present invention.
Figure 11:
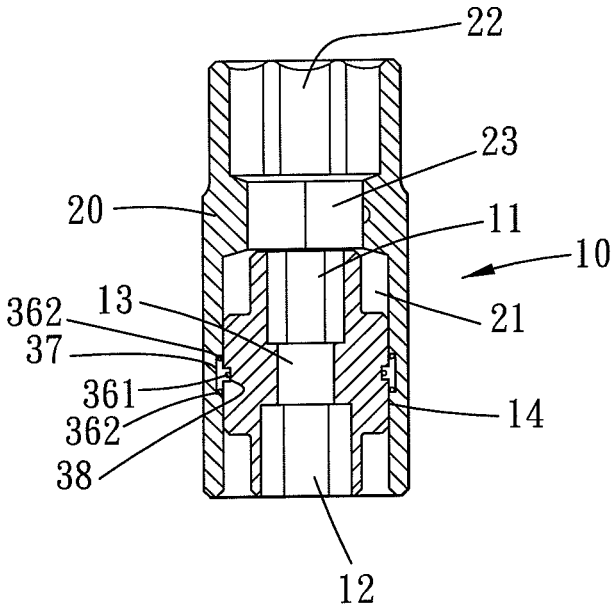
FIG. 11 is cross-sectional view of another socket set of the present invention.

Alternatively, as shown in FIGS. 10 and 11, the combination mechanism may include a limiting coil 36, a limiting slot 37 and a receiving groove 38. The limiting coil 36 has a small-radius middle section 361 and two large-radius side sections 362. The two side sections 362 are disposed at two sides of the middle section 361 respectively and received in the limiting slot 37, and the middle section 361 is received in and engaged against the receiving groove 38. The limiting slot 37 is formed in the third driving portion 21, and the receiving groove 38 is formed on the polygonal engaging surface 14. Whereby, when the first and second socket 10, 20 are combined together, the small-radius middle section 361 is received in the receiving groove 38 and the first and second sockets 10, 20 are retained together.

One single driving rod having a driving head might not be used for either of the first socket and the second socket if the first driven portion and the second driven portion are different in size. However, in the invention, the driving rod which can be used only for the first socket can be used to drive the second socket through fitting the first driven portion into the second driven portion, and similarly, the driving rod which can be used only for the second socket can be used to drive the first socket. In other words, in conventional applications, to drive different sockets of a socket set, plural driving rods corresponding the different sockets have to be prepared; however, by utilizing the socket set of the present invention, only one driving rod which corresponds to the first driven portion or the second driven portion is required, and the driving rod can be used to drive either of the first socket and the second socket. Hence, the insufficiency of driving rod for driving different sockets and the inconvenience of requiring plural driving rods can be avoided.

It should be noted that, the above-mentioned phrases "first socket" and "second socket" are used for differentiating two sockets literally. However the phrase "first socket" may refer to any socket that can be fitted in a driving portion of another socket, and the phrase "second socket" may refer to any socket, whose driving portion can be sleeved around and engaged against the outer circumferential surface of another socket. Therefore, a first socket (i.e., sleeved by another socket) used under some circumstances may be considered as a second socket (i.e., sleeved around another socket). In other words, for the above purpose, it requires only that the outer circumferential surface of each socket is formed with a polygonal engaging surface, and sockets of a socket set can be combined together according to actual various requirements, and thus it is more convenient. Additionally, although the present invention discloses an use of two sockets being combined together, uses of various amount of sockets, such as an use of three sockets being combined together, may be included by the spirit and scope of the invention. Furthermore, the socket set in the invention may include more than two sockets, that is, the socket set is not limited to the constitution of the first and second sockets, and as stated above, phrases "first socket" and "second socket" are used for differentiating two sockets literally. In fact, the numbers of first and second sockets are not limited to "one", that is, the socket set may include more than one first and second sockets.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket set, including:

a first socket, having an inner circumferential surface and an outer circumferential surface, the inner circumferential surface defining a first driving portion and a second driving portion at two sides of the first socket, a first driven portion being formed between the first and second driving portions, the first and second driving portions being adapted for driving a screwing member, the first driven portion being adapted to be driven by a driving rod having a driving head, and the outer circumferential surface formed with a polygonal engaging surface;

a second socket, having an inner circumferential surface and an outer circumferential surface, the inner circumferential surface defining a third driving portion and a fourth driving portion at two sides of the second socket, a second driven portion having a different size than the first driving portion being formed between the third and fourth driving portions, the third and fourth driving portions being adapted for driving a screwing member, and the second driven portion being adapted to be driven by a driving rod having a driving head; and a combination mechanism, wherein the polygonal engaging surface is adapted for being received in the third driving portion, the first and second sockets are in a cooperative-motion relationship, and the combination mechanism includes an engaging element and at least a first recess to retain the first and second sockets in a corresponding position.

2. The socket set of claim 1, wherein the first, second, third and fourth driving portions are substantially polygonal, and the amount of corners of the polygonal engaging surface is equal to that of the third driving portion.

3. The socket set of claim 1, wherein the combination mechanism further includes a second recess and a ring, the first recess is disposed around the polygonal engaging surface, the second recess is disposed around the third driving portion, the ring is received in the first recess or the second recess, and when the polygonal engaging surface is received in the third driving portion, the first and second recesses correspond to each other and the ring is limited in the first and second recesses.

4. The socket set of claim 1, wherein the engaging element is an engaging member and the at least a first recess is a receiving slot, the engaging member is disposed on one of the polygonal engaging surface and third driving portion, and the receiving slot is disposed on the other of polygonal engaging surface and third driving portion.

5. The socket set of claim 1, wherein the first, second, third and fourth driving portions are different from each other in size.

6. The socket set of claim 1, wherein the outer circumferential surface of the second socket is formed with a polygonal engaging surface.

7. The socket set of claim 1, wherein the combination mechanism further includes a limiting coil, a limiting slot and the at least a first recess is a receiving groove, the limiting coil has a small-radius middle section and two large-radius side sections, the two side sections are disposed at two sides of the middle section respectively and received in the limiting slot, the middle section is received in the receiving groove, the limiting slot is formed in the third driving portion, and the receiving groove is formed on the polygonal engaging surface.

* * * * *